US005926980A

United States Patent [19]

Adam

[11] Patent Number: 5,926,980

[45] Date of Patent: Jul. 27, 1999

[54] TWO-PIECE CLEAT ASSEMBLY

[75] Inventor: John M. Adam, Marietta, Ga.

[73] Assignee: Diversified Industrial Technology, Inc., Marietta, Ga.

[21] Appl. No.: 09/083,799

[22] Filed: May 22, 1998

Related U.S. Application Data

[60] Provisional application No. 60/053,023, Jul. 18, 1997.

[51] Int. Cl.[6] ..... A43B 5/02; A43C 13/04; A43C 15/16; A43C 15/02

[52] U.S. Cl. ..... 36/134; 36/67 D; 36/62; 36/67 A; 36/127

[58] Field of Search ..... 36/134, 67 R, 36/67 A, 67 D, 59 R, 62, 65, 126, 127, 34 A

[56] References Cited

U.S. PATENT DOCUMENTS

| | | | |
|---|---|---|---|
| D. 201,952 | 8/1965 | Johns | D7/5 |
| D. 395,156 | 6/1998 | Adam | D2/947 |
| 1,012,057 | 12/1911 | Brady . | |
| 1,230,118 | 6/1917 | Clifford . | |
| 1,232,896 | 7/1917 | Clifford . | |
| 1,304,616 | 5/1919 | Smith . | |
| 1,550,772 | 8/1925 | Allan . | |
| 1,554,580 | 9/1925 | Kaplan . | |
| 1,634,611 | 7/1927 | Deschamps . | |
| 1,827,514 | 10/1931 | Golden . | |
| 1,876,195 | 9/1932 | Youmans . | |
| 2,235,774 | 3/1941 | Pierce et al. | 36/59 |
| 2,261,785 | 11/1941 | Youmans | 36/59 |
| 2,383,117 | 8/1945 | Fellman | 36/59 |
| 2,412,788 | 12/1946 | Vietas et al. | 36/34 A |
| 2,677,905 | 5/1954 | Dye | 36/59 |
| 2,803,070 | 8/1957 | Passidomo et al. | 36/59 |
| 3,055,125 | 9/1962 | Ronci | 36/34 A |
| 3,119,192 | 1/1964 | Ronci | 36/34 A |
| 3,178,835 | 4/1965 | Burje et al. | 36/34 A |
| 3,186,112 | 6/1965 | Ball | 36/34 A |
| 3,225,465 | 12/1965 | Ball | 36/34 A |
| 3,271,885 | 9/1966 | McAuliffe | 36/2.5 |
| 3,302,227 | 2/1967 | Bente | 12/142 |
| 3,512,275 | 5/1970 | Leavitt | 36/59 |

(List continued on next page.)

FOREIGN PATENT DOCUMENTS

| | | |
|---|---|---|
| 407377 | 9/1909 | France . |
| 792190 | 9/1934 | France . |
| 73890 | 10/1917 | Germany . |
| 467815 | 2/1950 | Italy . |
| 209851 | 1/1924 | United Kingdom . |
| 2079138 | 1/1982 | United Kingdom . |
| 2265539 | 10/1993 | United Kingdom . |
| 15362 | 1/1999 | United Kingdom . |

OTHER PUBLICATIONS

Here's the Soft Golf Spike That's Hard To Beat Champ Trend–Lite–Belived to be known prior to Aug. 1, 1996.

*Primary Examiner*—B. Dayoan
*Assistant Examiner*—Anthony Stashick
*Attorney, Agent, or Firm*—Womble Carlyle Sandridge & Rice; Louis T. Isaf

[57] ABSTRACT

A two-piece releasably securable cleat assembly for an athletic shoe, and particularly a golf shoe, formed of a pair of interengaging members which are preferably molded of plastic. In a preferred embodiment, the cleat assembly includes a first member comprised of a T-shaped threaded stem having a plurality of arms projecting radially and perpendicular from an end thereof, the stem for threadably engaging a complementary threaded bore or boss in the sole and/or heel of the shoe. The second member, interengagable with the T-shaped threaded stem, includes a generally circular base having an essentially planar top surface and a lower surface characterized by a plurality of traction enhancing arcuate legs which are preferably arranged in plural concentric circles on the lower surface. The base further features a central opening for snugly and slidably receiving the T-shaped threaded stem of the first member to releasably secure the second member to the shoe sole and/or heel.

22 Claims, 5 Drawing Sheets

U.S. PATENT DOCUMENTS

| | | | |
|---|---|---|---|
| 3,656,245 | 4/1972 | Wilson | 36/67 D |
| 3,707,047 | 12/1972 | Nedwick | 36/2.5 R |
| 4,014,114 | 3/1977 | Jordan et al. | 36/67 |
| 4,205,466 | 6/1980 | Collins | 36/67 |
| 4,299,038 | 11/1981 | Epple | 36/67 |
| 4,306,360 | 12/1981 | Hagger | 36/59 |
| 4,577,422 | 3/1986 | Tanel | 36/126 |
| 4,653,206 | 3/1987 | Tanel | 36/126 |
| 4,689,901 | 9/1987 | Ihlenburg | 36/126 |
| 4,748,752 | 6/1988 | Tanel | 36/126 |
| 5,029,405 | 7/1991 | DeHaitre | 36/134 |
| 5,259,129 | 11/1993 | Deacon et al. | 36/127 |
| 5,623,774 | 4/1997 | Abbey | 36/134 |
| 5,655,317 | 8/1997 | Grant | 36/134 |
| 5,791,071 | 8/1998 | Rosdail | 36/134 |

TWO-PIECE CLEAT ASSEMBLY

CROSS-REFERENCE TO RELATED APPLICATION

This application claims the benefit of U.S. Provisional application Ser. No. 60/053,023, filed Jul. 18, 1997.

FIELD OF THE INVENTION

This invention relates generally to athletic shoes, and more particularly to releasably securable cleats for use on the soles and/or heels of such shoes, where improved traction and performance by the user is desired.

BACKGROUND OF THE INVENTION

The invention is directed to an improved two-piece cleat assembly for use on athletic shoes, and in particular, golf shoes. Athletic shoes having soles and heels with protruding cleats have long been used by athletes to enhance the traction and position stabilization of the feet of the user. From early years, the athletic shoe cleats were configured as metal spikes, and eventually "soft spikes" (e.g., made of synthetic materials, such as hard nylons and plastic), that project downwardly from the soles of their shoes and into the soil or turf of the field of play. The spiked cleat is presently used in athletic shoes for sports as wide ranging as football, baseball, soccer and golf. Because the metal and synthetic spikes will wear down, and sometimes break, the spiked cleats were eventually incorporated as part of a replaceable cleat system which included a plurality of threaded metal screw bosses or sleeves embedded into the sole and/or heel of the shoe and into which the spikes, outfitted with a threaded stem, were threaded.

The traditional spiked cleats fulfilled the intended purpose of aiding in traction and position stabilization of the feet during the stationary swinging efforts of golf, for example, as well as during encounters of opposition or in instances where enhancement of forward momentum was desirable. Eventually, with the aid of studies and research, it was determined that, while spiked cleats provide aggressive traction for sports such as football and baseball, not all sports require such radical traction. Furthermore, the value of the spiked cleat is being questioned even in such aggressive sports, where knee and other injuries are sometimes attributed to the athlete making rapid and abrupt direction changes, yet the overly aggressive traction of the typical elongated cleats is traditionally deemed necessary for such sports. Moreover, several concerns have developed in regard to the collateral damage to non-sport surfaces from players wearing spiked shoes and walking thereupon.

One sport, where the concern seems to have shifted to the walking surface, rather than physical damage to the user, is golf. In this sport of traditionally metal, spiked cleats, the tendency of metal spiked cleats to pit and deface surfaces, such as concrete walks, wooden floors, and carpet is well-known. Even on the golf course, inadvertent scuffing by a golfer dragging his or her feet can cause severe damage to the "greens." Golf courses throughout the United States, in increasing numbers, are banning metal spikes in favor of "soft spikes" in an attempt to minimize the aforementioned damages caused by the metal spikes.

In addition to problems associated with injuries and damage to surrounding properties, the traditional screw-in type replacement cleat shoe system has other problems associated with the use of metal screw bosses that are embedded in shoe soles and heels for receiving cleats. One significant problem is that the bosses tend to oxidize or rust over time because they are continuously exposed to moisture during wear. This makes it very difficult in some instances, due to metal seizing, to remove an old cleat and replace it with a new cleat and, in extreme cases, can render the boss unusable.

Presently, in many sports, including golf, alternatives to the spiked cleat (both metal and synthetic) are available. Such alternatives include the elimination of spiked cleats of any kind and replacing cleated soles and heels with soft, raised treads. However, as the treads wear to the point of lost traction, the shoes "wear out" and become useless—an expensive alternative to spiked cleats. Other alternatives have been to retain the cleat concept on the shoe while eliminating the undesirable extending rigid "spike". One example of such is found in U.S. Pat. No. 5,259,129. Furthermore, it is not unknown in the art to at least provide a synthetic screw boss in athletic shoes, an example of which being U.S. Pat. No. 4,299,038.

U.S. Pat. No. 4,723,366 represents another approach to a removably attachable cleat including a conventional metal spike member having a stem portion at one end, a traction engaging spike axially aligned with the stem at the other end, and an intermediate flanged portion. It is disclosed therein that a plastic skirt is overmolded about the flanged portion to form a unitary skirt and flange.

In spite of prior art efforts, there remain challenges and problems for which improvements are useful; and, the present invention is intended to address some of those challenges and problems with the development of an improved, two-piece, non-metallic "soft cleat".

SUMMARY OF THE INVENTION

The present invention comprises an improved athletic shoe, and more particularly an improved cleat assembly removably threaded to a complementary threaded bore or boss embedded in and exposed in the sole and/or heel of such athletic shoe. A preferred embodiment of this invention is a cleat assembly for use as a replacement cleat for a golf shoe, which typically includes an array of existing embedded threaded bores or bosses in the sole of the golf shoe.

The cleat assembly of the present invention comprises a two-piece assembly consisting of a pair of components, preferably molded of pliant plastic, such as a pliable PVC. A first of such components comprises a T-shaped threaded member having a threaded stem for engagement with a complementary threaded bore or boss of the sole of the shoe, and a plurality of radial arms extending generally at right angles from an end of the stem.

The second component comprises an essentially flat disk-shaped base, having a plurality of arcuate-shaped ridges projecting downwardly from the base. In a preferred embodiment, the ridges are arrayed or grouped in a pattern that is subdivided into four quadrants by a pair of diametrically extending channels, where the channels further include radially extending troughs for snugly receiving the arms of the T-shaped threaded member in the assembled condition. With the ridges arranged in essentially concentric circles about the disk-shaped base, an arcuate-shaped trough appears between concentric ridges within a quadrant, where such troughs communicate with the channels at the trough ends.

For added strength, the innermost ridge of each quadrant may be provided with a radial, inwardly directed support. The supports, preferably four in number, terminate at a central through hole in the base. The hole is dimensioned to snugly and slidably receive the stem of the T-shaped threaded member. The mounting of the cleat assembly is achieved by inserting the threaded stem into the central through hole in the base, with the plurality of arms of the T-shaped threaded member snugly nesting in the radially extending troughs along the channels, then threadably engaging such stem into a selected threaded bore or boss, by the application of a simple hand tool, such as a Phillips or flathead screwdriver. To replace a cleat assembly, one merely disengages the cleat assembly from the shoe and replaces the flat disk-shaped base with a new such component, followed by reengagement.

Other features, objects, and advantages of the present invention will become apparent to those skilled in the art from reading the following Detailed Description of the Preferred Embodiment, particularly when read in conjunction with the accompanying Brief Description of the Drawings and claims appended herewith.

DETAILED DESCRIPTION OF THE PREFERRED EMBODIMENT

Figures 1, 2:
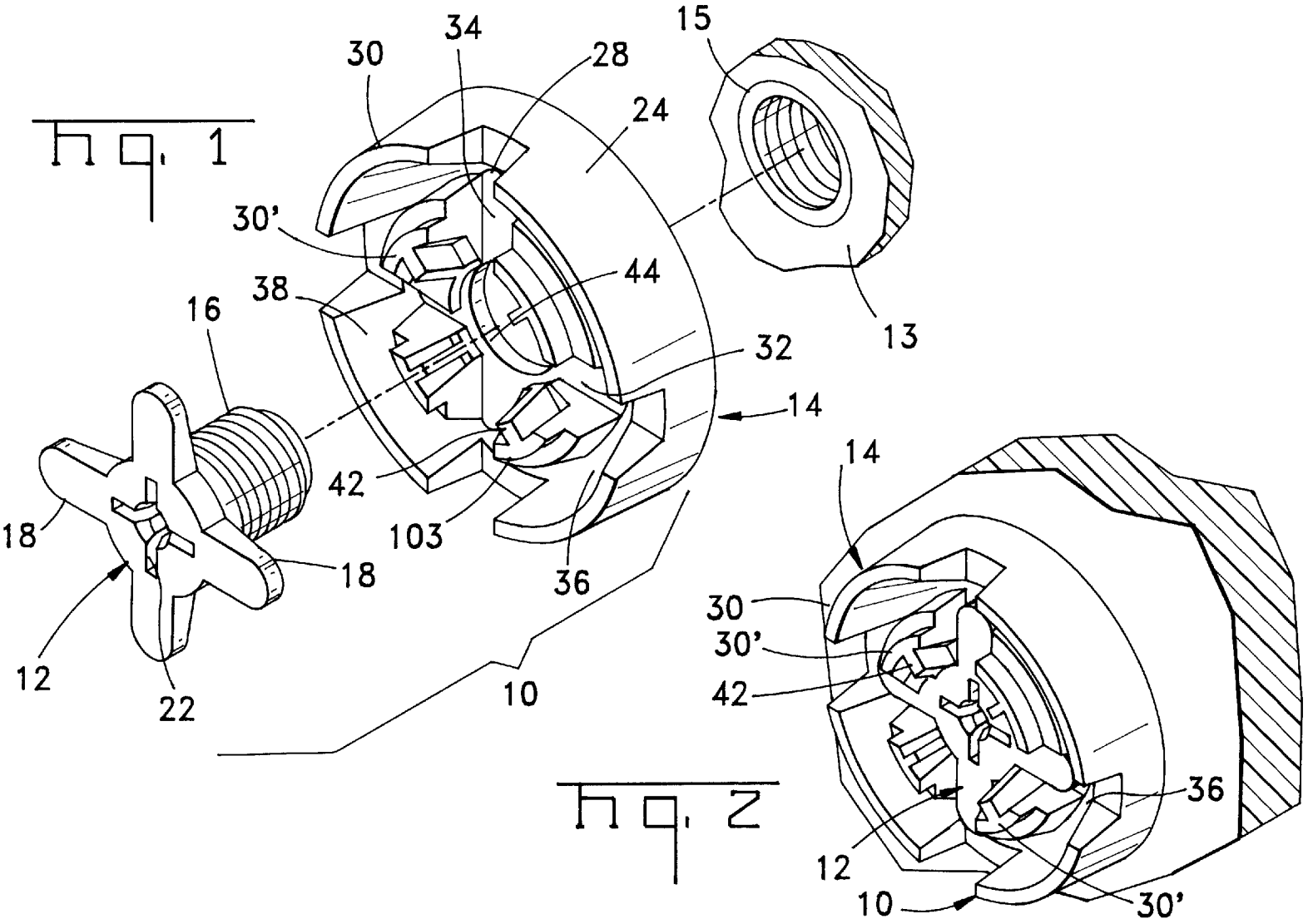
FIG. 1 is an isolated perspective view of the preferred embodiment two-piece cleat assembly illustrating the first and second interengaging members of the assembly positioned for entry and removable engagement with a selected threaded bore or boss in the sole of an athletic shoe.
FIG. 2 is an assembled view of the cleat assembly of FIG. 1.

The invention relates to an improved cleat assembly to provide enhanced traction to an athletic shoe, with particular application to golf shoes, and provide support and comfort to the wearer. Referring now to the drawings illustrating the improved cleat assembly, wherein like numerals reference like parts throughout the several views, FIG. 1 shows a preferred embodiment of the cleat assembly 10 of this invention. The cleat assembly 10 comprises a two-piece, interengagable assembly consisting of a first T-shaped threaded member 12 and a second traction enhancing member 14, both of which are preferably molded of a pliant plastic, such as pliable PVC, and which are assembled into the combination shown in FIGS. 2 and 6.

Figures 6, 7, 8:
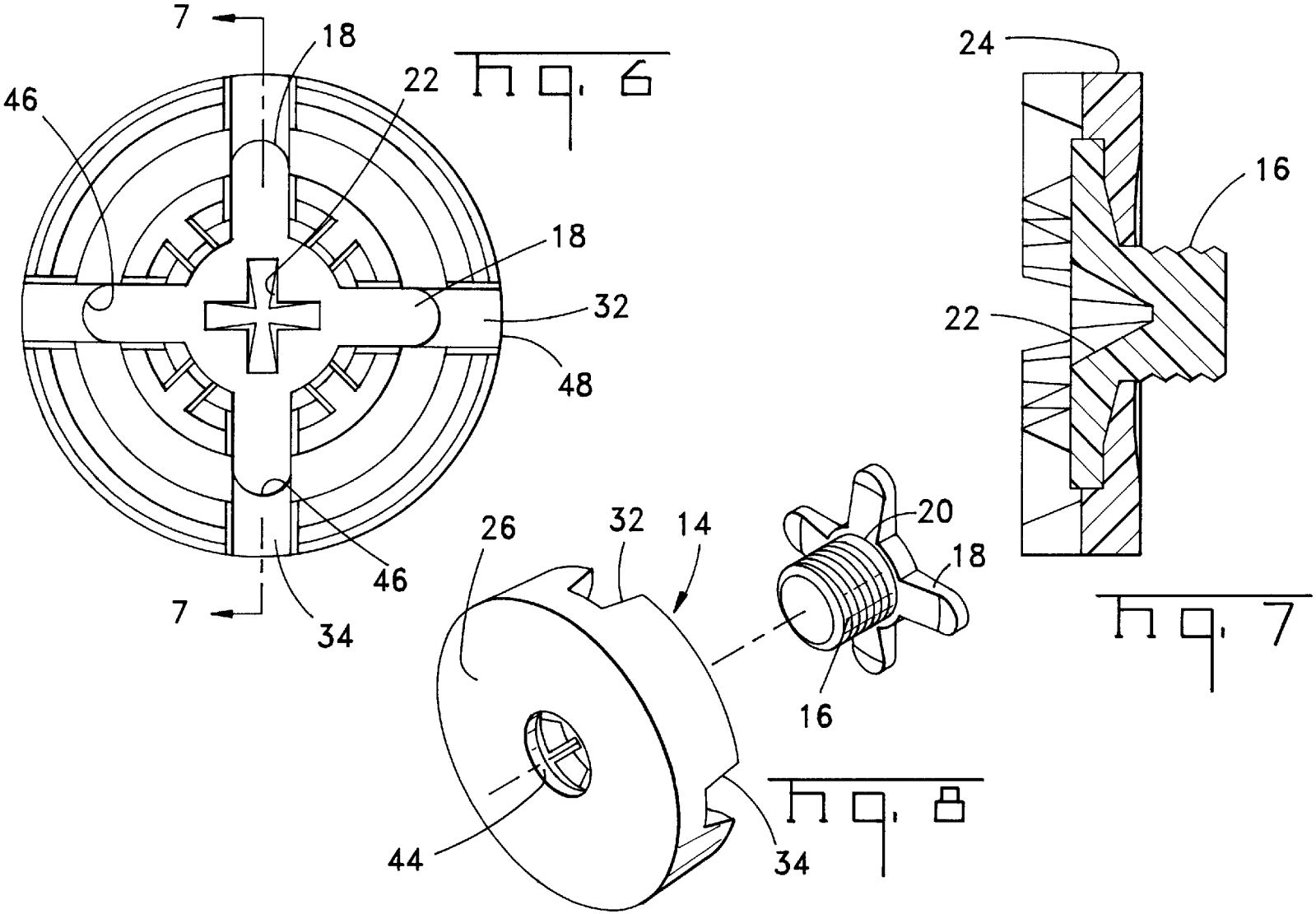
FIG. 6 is a bottom view similar to FIG. 3, showing the two-piece cleat assembly of this invention with the first interengaging member fitted upon and through the second interengaging member.
FIG. 7 is a partial sectional view, taken along line 7—7 of FIG. 6, showing the interengagement of the two interengaging members.
FIG. 8 is a top, isolated perspective view of the two interengaging members of the two-piece cleat assembly opposite the view of FIG. 1.
Figure 9:
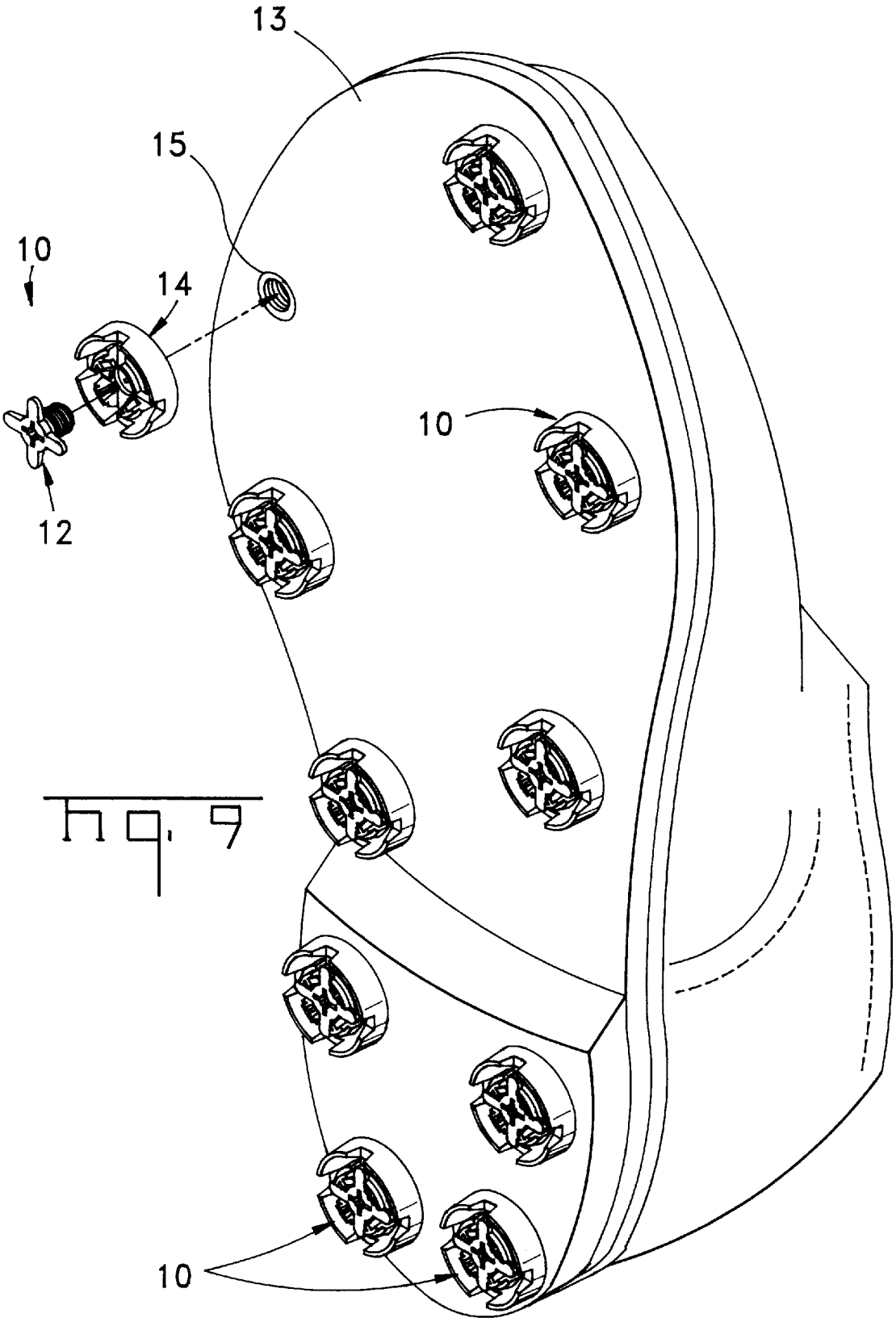
FIG. 9 is a bottom perspective view illustrating a plurality of two-piece assemblies mounted to the sole and heel of an athletic shoe, such as a golf shoe, and a single isolated assembly positioned for engagement with the sole of the shoe.

Briefly, and by way of additional background, the type of athletic shoes to which this invention is applicable are those that include an array of threaded bores or bosses arranged within and along the sole 13 and heel of the shoe, as shown in FIG. 9. Typically, a threaded bore 15 or boss is recessed within the sole 13 such that the opening thereof is generally flush with the sole 13 surface. In some instances, certain athletic shoe designs may include a slight circular recess about the threaded bore 15 or boss for seating of a cleat assembly. In any case, the improved cleat assembly 10 hereof is intended to threadably and releasably engage such threaded bores or bosses, as best seen in FIGS. 1, 7, and 9.

Figure 11:
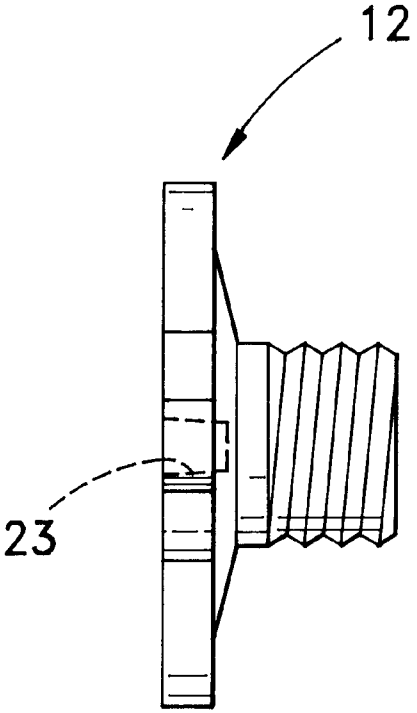
FIG. 11 is a side view of the embodiment of the T-shaped threaded member of FIG. 10.
Figure 10:
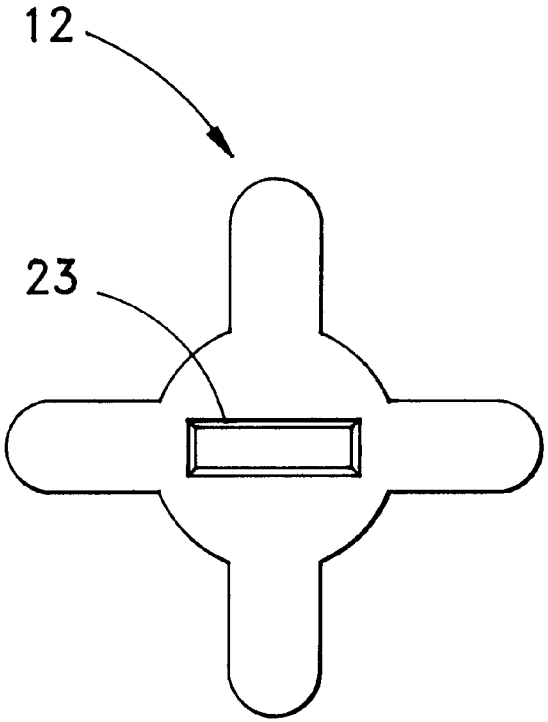
FIG. 10 is a bottom view of the T-shaped threaded member of the two-piece cleat assembly of the present invention showing an alternate embodiment thereof, and displaying characteristic dimensions of one exemplary embodiment.

Returning now to the improved cleat assembly 10 of this invention as particularly shown in FIG. 1, the T-shaped threaded member 12 comprises a threaded stem 16, the threads of which are complementary of the inner threads of the bore 15 or boss in the shoe's sole or heel, and a plurality of radial arms 18 extends perpendicular to the stem 16, from one end 20 thereof Preferably there are four such arms 18, generally rectangular in cross-section and arranged in a common plane, where each arm 18 is angled about 90°, or equidistant, from other adjacent arms 18. The stem 16, at the end 20, is further characterized by angled slots 22 for receiving a hand tool, such as a Phillips screwdriver, shown in the embodiment of FIGS. 1–9 or a single slot 23 for receiving a flathead screwdriver as shown in FIGS. 10 and 11, as known in the art, for releasably engaging the cleat assembly 10 to the athletic shoe, as hereinafter explained. Alternatively, any shaped recess may be provided on the end 20 of T-shaped threaded member 12 to accommodate a hand tool to effectively rotate the threaded stem 16 and attach and detach the cleat assembly.

Figure 3:
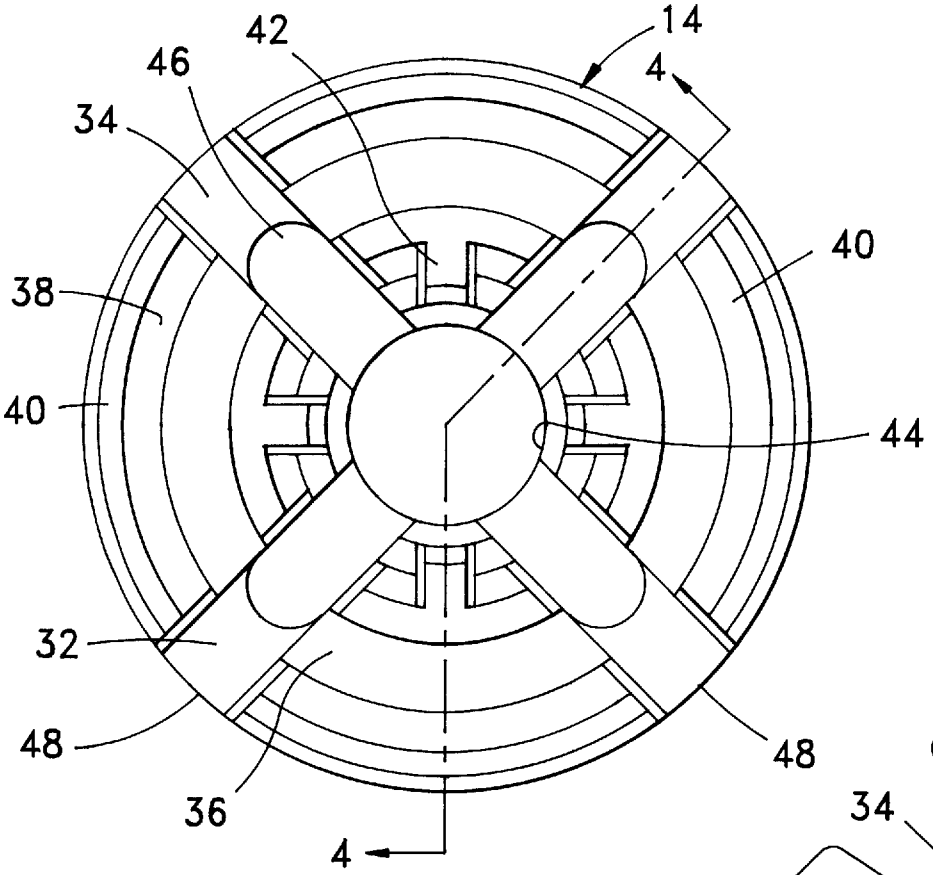
FIG. 3 is a bottom view of the second interengaging member of the two-piece cleat assembly of FIG. 1, illustrating the traction engaging surface thereof.

The traction enhancing member 14, as best seen in FIGS. 1 and 3, comprises a generally circular or disk-shaped base 24, typically about ⅞ inches in diameter, having an essentially planar upper surface 26, arranged to lie contiguous with the essentially planar surface of the sole 13 and heel of the athletic shoe, and further includes a bottom surface 28. In a preferred embodiment, the bottom surface 28 includes a plurality of arcuate-shaped ridges 30, 30' arranged in one or more concentric circles about the bottom surface. Further, first and second diametrically extending mutually transversely oriented channels 32, 34 extend across the bottom surface 28, dividing or grouping the arcuate-shaped ridges 30 within a quadrant, and a trough 36 extending therebetween is in communication, at its ends, with the respective channels 32, 34. It was discovered that this configuration provided a path for air and water to move quickly from the trough 36 to the channels 32, 34, and away from the cleat assembly. Additionally, such configuration provides an "air cushioned" support system which enhances the wearing comfort to the athlete.

Figure 4:
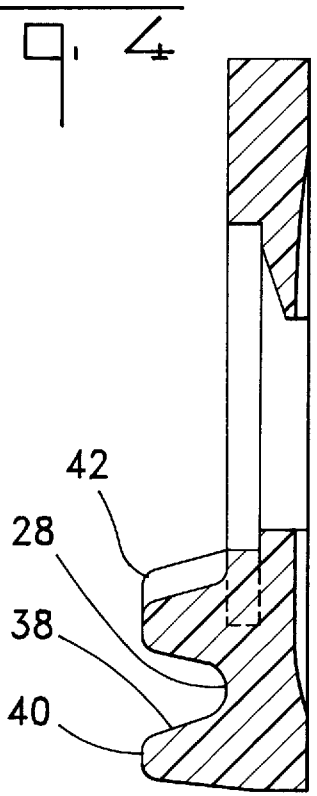
FIG. 4 is a partial sectional view taken along line 4—4 of FIG. 3.

To improve the strength of the arcuate-shaped ridges 30, and to enhance traction for the wearer, the ridges 30 are provided with tapered walls 38, shown in FIGS. 3 and 4, that is, converging in a direction away from the bottom surface 28 to a flattened edge 40. Additionally, the inner most arcuate-shaped ridges 30' may be provided with radial, inwardly directed supports 42 to augment and support such ridges.

Figure 5:
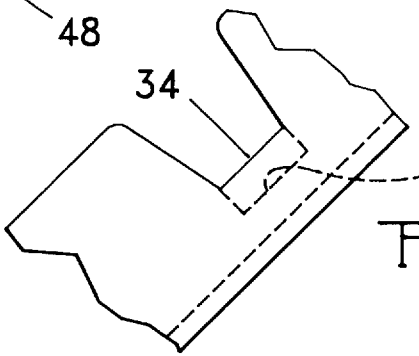
FIG. 5 is a partial side view of the second interengaging member of FIG. 3, illustrating one of a pair of diametrically extending mutually transversely oriented channels along the bottom.

To receive and interengage with the T-shaped threaded member 12, the traction enhancing member 14 includes a central through hole 44 shown in FIGS. 1 and 8, separating said supports 42 and sized to slidably and snugly receive the stem 16, and plural grooved recesses 46 radiating from the central hole 44 along said channels 32, 34 to positions in near proximity to the peripheral edge 48 of the base 24, as illustrated in FIGS. 3–5. The contour of the grooved recesses 46 is complementary to the generally rectangular cross-sectioned shape of the radial arms 18, so as to snugly receive the radial arms 18 within the grooved recesses 46, as particularly shown in FIGS. 5 and 6.

The engagement of the respective components is simple, with only a common hand tool such as a key or screwdriver necessary to releasably engage the cleat assembly to the golf shoe through rotation of the T-shaped threaded member 12. The T-shaped threaded member 12 is oriented with the stem 16 accessible, and fed through the central hole 44, from the bottom surface 28, where the radial arms 18 seat into respective grooved recesses 46. In this arrangement, the cleat assembly is then threaded into a threaded bore 15 or boss within the sole 13 of the athletic shoe, as illustrated in FIGS. 1, 7, 8, and 9.

While there has been shown the preferred and alternate embodiments of the present invention, it is to be understood that the invention may be embodied otherwise than is herein specifically shown and described, and that within said embodiments, certain changes may be made in the form and arrangements of the elements without departing from the underlying ideas or principles of this invention as set forth in the claims appended herewith.

What is claimed is:

1. A cleat assembly for removably securing a cleat to an athletic shoe having an essentially planar lower surface and an array of exposed, recessed threaded bores, said cleat assembly comprising:

a first interengaging member and second interengaging member, said first interengaging member comprising a T-shaped member including a threaded stem and a plurality of arms projecting radially and generally perpendicular to said threaded stem, and said second interengaging member comprising a generally circular base having an essentially planar top surface and a lower surface exhibiting a plurality of arcuate legs extending downwardly from the lower surface of said base, and a central opening through the base from the lower surface through the top surface in said base, whereby said threaded stem of said first interengaging member projects through said central opening of said second interengaging member to threadingly engage a designated threaded bore thereby releasably securing said cleat assembly to said shoe, and releasably interengaging said first and second interengaging members.

2. The cleat assembly of claim 1, wherein said second interengaging member includes a pair of diametrically extending channels formed across the lower surface of said base, and said channels being comparably configured to receive said plurality of arms of said first interengaging member.

3. The cleat assembly of claim 2, wherein said channels include grooves extending in near proximity to a periphery of said generally circular base and said channels being configured to snugly seat said plurality of arms.

4. The cleat assembly of claim 2, wherein said arcuate legs of said second interengaging member are arranged in plural concentric circles about said lower surface.

5. The cleat assembly of claim 4, wherein said innermost circle of said arcuate legs includes at least one inwardly, radially directed support.

6. The cleat assembly of claim 3, wherein said pair of diametrically extending channels of said second interengaging member are oriented at substantially right angles relative to each other to subdivide said arcuate legs into quadrants.

7. The cleat assembly of claim 6, wherein said plurality of arms of said first interengaging member consist of four arms in a common plane and equidistant from each other.

8. The cleat assembly of claim 1, wherein said arcuate legs of said second interengaging member include tapered side walls converging from said lower surface to a remote flat, traction engaging surface.

9. The cleat assembly of claim 1, wherein said first and second interengaging members are molded and of a non-metal material.

10. The cleat assembly of claim 1, wherein said top surface of said second interengaging member is contoured to lie contiguous with the essentially planar lower surface of the athletic shoe.

11. The cleat assembly of claim 1, wherein said T-shaped member further includes a shaped recess to accommodate a hand tool.

12. In combination, an athletic shoe including a sole having an upper surface with an upper portion extending therefrom for receiving a foot therein, and a generally planar lower surface including an array of exposed, recessed threaded bores for threadably engaging a traction enhancing cleat assembly; and a plurality of cleat assemblies, each cleat assembly of said plurality of cleat assemblies releasably engaging one of said threaded bores, said cleat assembly comprising first and second interengaging members, said first interengaging member comprising a T-shaped member including a threaded stem and a plurality of arms projecting radially and generally perpendicular from said threaded stem, and said second interengaging member comprising a generally circular base having an essentially planar top surface and a lower surface exhibiting a plurality of arcuate legs extending downwardly from the lower surface of said base, and a central opening, completely through said base including the top surface and the bottom surface;

whereby said threaded stem of said first interengaging member projects through said central opening of said second interengaging member from said lower surface through said top surface to threadably engage a designated threaded bore thereby releasably securing said cleat assembly to said shoe, and releasably interengaging first and second interengaging members.

13. The combination of claim 12, wherein said second interengaging member includes a pair of diametrically extending channels formed across the lower surface of said base, and said channels being comparably configured to receive said plurality of arms of said first interengaging member.

14. The combination of claim 13, wherein said channels include grooves extending in near proximity to a periphery of said generally circular base and said channels configured to snugly seat said plurality of arms.

15. The combination of claim 13, wherein said arcuate legs of said second interengaging member are arranged in plural concentric circles about said lower surface.

16. The combination of claim 15, wherein said innermost circle of said arcuate legs of said second interengaging member includes at least one inwardly, radially directed support extension.

17. The combination of claim 14, wherein said pair of diametrically extending channels of said second interengaging member are oriented at substantially right angles relative to each other to subdivide said arcuate legs into quadrants.

18. The combination of claim 17, wherein said plurality of said first interengaging member consist of four arms in a common plane and equidistant from each other.

19. The combination of claim 12, wherein said arcuate legs of said second interengaging member include tapered walls converging from said lower surface to a remote flat, traction engaging surface.

20. The combination of claim 12, wherein said first and second interengaging members are molded and of a non-metal material.

21. The combination of claim 12, wherein said top surface of said second interengaging member is contoured to lie contiguous with said generally planar lower surface of said athletic shoe.

22. The combination of claim 12, wherein said T-shaped member further includes a shaped recess to accommodate a hand tool.

* * * * *